United States Patent [19]

McCollum

[11] 4,266,608

[45] May 12, 1981

[54] METHOD FOR DETECTING UNDERGROUND CONDITIONS

[75] Inventor: John D. McCollum, Naperville, Ill.

[73] Assignee: Standard Oil Company (Indiana), Chicago, Ill.

[21] Appl. No.: 63,426

[22] Filed: Aug. 3, 1979

Related U.S. Application Data

[62] Division of Ser. No. 925,178, Jul. 17, 1978.

[51] Int. Cl.[3] ..... E21B 43/243; E21B 47/00; E21B 47/12

[52] U.S. Cl. ..... 166/250; 166/251; 324/338

[58] Field of Search ..... 324/338; 166/250, 251, 166/252, 65 R, 66

[56] References Cited

U.S. PATENT DOCUMENTS

| | | | |
|---|---|---|---|
| 4,045,724 | 8/1977 | Shuck et al. | 324/338 |
| 4,092,583 | 5/1978 | Coates | 324/338 |
| 4,120,354 | 10/1978 | Ridley et al. | 166/251 |
| 4,161,687 | 7/1979 | Lytle et al. | 324/338 |

FOREIGN PATENT DOCUMENTS

| | | | |
|---|---|---|---|
| 1057519 | 2/1967 | United Kingdom | 324/338 |

*Primary Examiner*—Stephen J. Novosad
*Attorney, Agent, or Firm*—Ronald C. Petri; William T. McClain; William H. Magidson

[57] ABSTRACT

Disclosed is a method for detecting the flame front during the in situ combustion of a subterranean carbonaceous stratum which involves providing one or more radio transmitters below the surface of the ground, each of said transmitters being capable of sensing and transmitting information concerning the physical and chemical properties of its surroundings, and monitoring said transmissions as an indication of the extent and movement of said flame front. Also disclosed is a method for detecting non-uniform packing characteristics of rubblized material which involves providing one or more radio transmitters within the boundaries of a retort capable of sensing and transmitting information concerning the physical parameters of its surroundings, and monitoring said transmissions as an indication of the size and density distributions of the rubble in said retort.

5 Claims, 1 Drawing Figure

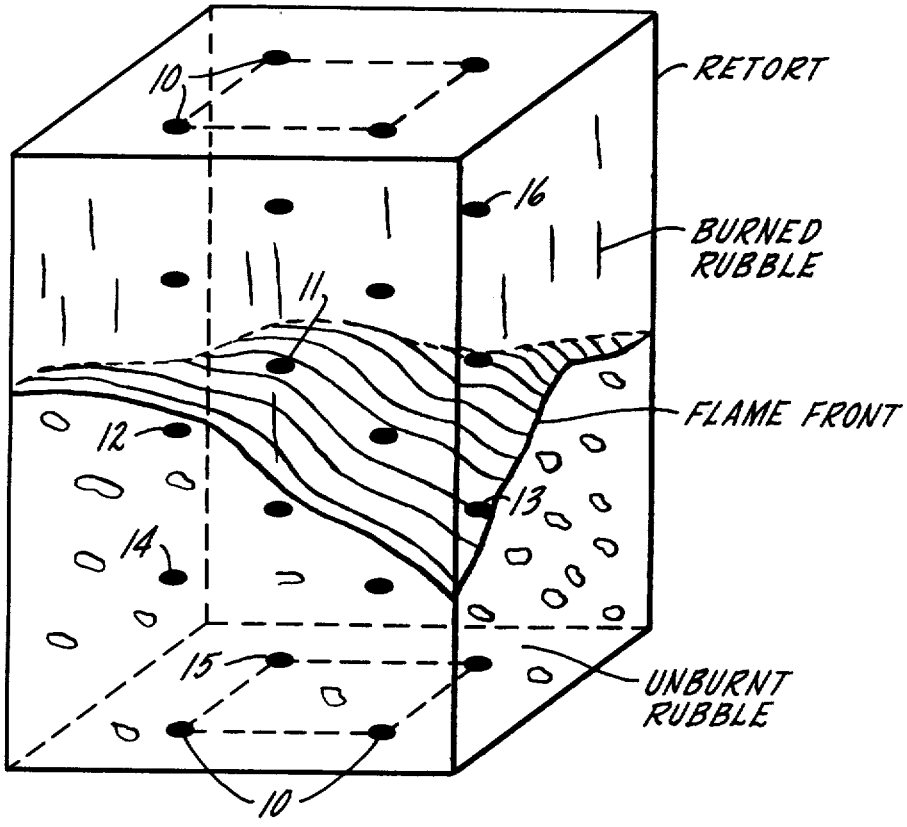
RETORT
BURNED RUBBLE
FLAME FRONT
UNBURNT RUBBLE
10
11
12
13
14
15
16
10

METHOD FOR DETECTING UNDERGROUND CONDITIONS

This is a division of application Ser. No. 925,178, filed July 17, 1978.

BACKGROUND

1. Field of the Invention

This invention relates to a method of monitoring the progress and pattern of a combustion or flame front being advanced through a combustible subterranean carbonaceous stratum. In particular, this invention relates to a method of monitoring both the vertical and lateral movement of an underground flame front. More particularly, this invention relates to a method of monitoring the pattern and spatial orientation of a flame front during in situ retorting of oil shale. This invention also relates to a method of determining the presence of variations in the size and density distribution of the rubblized shale in a retort.

2. Description of the Prior Art

The term oil shale refers to sedimentary deposits containing organic materials which can be converted to oil shale. Oil shale contains an organic material called kerogen which is a solid carbonaceous material from which shale oil can be retorted. Upon heating oil shale to a sufficient temperature, kerogen is decomposed and a liquid product is formed.

Oil shale can be found in various places throughout the world, especially in the United States in Colorado, Utah and Wyoming. Some especially important deposits can be found in the Green River formation in the Piceance Basin, Garfield and Rio Blanco counties, and northwestern Colorado.

Oil shale can be retorted to form a hydrocarbon liquid either by in situ or surface retorting. In surface retorting, oil shale is mined from the ground, brought to the surface, and placed in vessels where it is contacted with hot retorting gases. The hot retorting gases cause shale oil to be freed from the rock. Spent retorted oil shale which has been depleted in kerogen is removed from the reactor and discarded.

In situ combustion techniques are being applied to shale, tar sands, Athabasca sand and other strata in virgin state, to coal veins by fracturing, and to strata partially depleted by primary and even secondary and tertiary recovery methods.

In situ retorting oil shale generally comprises forming a retort or retorting area underground, preferably within the oil shale zone. The retorting zone is formed by mining an access tunnel to or near the retorting zone and then removing a portion of the oil shale deposit by conventional mining techniques. About 5 to about 40 percent, preferably about 15 to about 25 percent, of the oil shale in the retorting area is removed to provide void space in the retorting area. The oil shale in the retorting area is then rubblized by well-known mining techniques to provide a retort containing rubblized shale for retorting.

A common method for forming the underground retort is to undercut the deposit to be retorted and remove a portion of the deposit to provide void space. Explosives are then placed in the overlying or surrounding oil shale. These explosives are used to rubblize the shale and preferably form rubble with uniform particle size. Some of the techniques used for forming the undercut area and the rubblized area are room and pillar mining, sublevel caving, and the like.

After the underground retort is formed, the pile of rubblized shale is subjected to retorting. Hot retorting gases are passed through the rubblized shale to effectively form and remove liquid hydrocarbon from the oil shale. This is commonly done by passing a retorting gas such as air mixed with steam and/or hydrocarbons through the deposit. Most commonly, air is pumped into one end of the retort and a fire or flame front initiated. This flame front is then passed slowly through the rubblized deposit to effect the retorting. Not only is shale oil effectively produced, but also a mixture of off-gases from the retorting is also formed. These gases contain carbon monoxide, ammonia, carbon dioxide, hydrogen sulfide, carbonyl sulfide, and oxides of sulfur and nitrogen. Generally a mixture of off-gases, water and shale oil are recovered from the retort. This mixture undergoes preliminary separation (commonly by gravity) to separate the gases, the liquid oil, and the liquid water. The off-gases commonly also contain entrained dust and hydrocarbons, some of which are liquid or liquefiable under moderate pressure. The off-gases commonly have a very low heat content, generally less than about 100 to about 150 BTU per cubic foot.

One problem attending shale oil production in in situ retorts is that the flame front may "channel" through rare combustible portions of the rubble faster than others. The resulting uneven passage of the flame can leave considerable portions of the rubblized volume bypassed and unproductive. Such channeling can result from non-uniform size and density distributions in the rubblized shale. If the shape of the flame front can be defined or packing variations detected within the retort, then channeling and its effects can be mitigated by controlling the air injection rate and oxygen content into various sectors of the retort, or by secondary rubblization if regions of poor density can be mapped.

A variety of prior art techniques have been established for determining the position and progress of underground combustion. These techniques range from indirect theoretical mathematical formulations on the one hand to rather simplistic direct measurements that can be done at the combustion site on the other. One example of the mathematical treatment can be found in a paper ("Locating a Burning Front by Pressure Transient Measurements," Paper No. SPE 1271) by Hossein Kazemi delivered at the OCTOBER, 1965, Society of Petroleum Engineers Conference. Kazemi disclosed a method by which the distance from a measuring point to the combustion front could be calculated employing pressure transient measurements. In particular, the pressure fall-off observed at the bottom of the well hole in either injected liquid or in effluent gases could be related to the approach of a combustion front. Such pressure build-up and fall-off measurements were also described by H. K. Van Poolen in the Feb. 1, 1965 *Oil and Gas Journal*, Vol. 63, No. 5.

An equally elaborate technique was described by Dr. A. M. Feder in 1967 ("Infrared Sensing: New Way to Track Thermal Flood Fronts," *World Oil* (April, 1967), P. 142) using an infrared system to locate subterranean thermal fronts by flying an infrared sensor over the investigated area. Thermal energy from a sub-surface heat source (combustion or steam-fronts) may be transferred to the terrain surface by conduction through the overburden formation, or by movement of heated water or gases to the surface via fractures. Infrared imaging would then be useful to identify the hot portions of the surface terrain. This method however is only a gross estimate of the position of an underground thermal front and does not yield reliable data on its depth, extent or movement.

Parker discloses in U.S. Pat. No. 3,031,762 the periodic measurement of the elevation of the ground at one or more points directly above the path of a combustion front until the ground at this point rises. Such a rise is interpreted to indicate the arrival of the combustion front directly under the elevated point. This method is dependent on the fact that combustion of a carbonaceous stratum causes an expansion of the stratum which is substantially immediately translated to a rise in the elevation of the ground surface directly over the expanded stratum. This method is uniquely applicable to combustion fronts which are primarily vertical and which move in a horizontal direction. Combustion fronts in the horizontal plane that propagate vertically would simply result in a roughly symmetrical elevated area with no information provided concerning the depth or speed of the front.

Parker also teaches in U.S. Pat. No. 3,072,184 a fuel pack in which separate masses of gas forming materials are spaced in the fuel pack at predetermined distances. Thus as the fuel pack burns it releases identifiable gases at spaced intervals which, when detected in the effluent gases, can be related to the progress of the combustion front in that particular fuel pack. This method is primarily useful in well bores and is not readily amenable to application in underground retorting.

U.S. Pat. No. 3,454,365 issued to Lumpkin et al discloses a method in which the gas from in situ combustion process is analyzed for its oxygen, carbon dioxide, hydrogen and hydrocarbon content. A small sample stream from the hot effluent during in situ combustion is treated, condensed and dried. It is subsequently analyzed to determine the relative concentrations of the various off-gases. This concentration level is then rationalized through a control computer which controls the air injection rate to maintain an optimum utilization of the oxygen in the air stream and to optimize the in situ cracking process. This process is directed primarily towards detecting the efficiency or effectiveness of the combustion process within the retort, and does not provide usable information concerning the speed, progress, extent or location of the flame front within the retort.

In U.S. Pat. No. 3,467,189, Dingley also employs a sample-and-analysis technique to detect the approach of a flame front. Physical properties such as the water to air ratio of the formation fluids which enter a production well are monitored, as well as the hydrogen ion concentration and the salinity of the water and the specific gravity of the liquid hydrocarbons. A signal indicating the close proximity of the combustion front to the production well is provided when limiting or static values are reached at the same time in any two of the physical properties of the formation fluids entering the production valve.

U.S. Pat. No. 3,483,730, issued to Gilchrist et al, employs thermocouples to monitor the change in temperature of the overburden near the ground surface at a plurality of points spaced around the point at which the combustion is initiated. These thermocouples respond to changes in temperature of the overburden during the heat movement of the underground combustion and thereby detect lateral movement of the flame front.

Related to the teachings of U.S. Pat. No. 3,483,730 is a method involving down-hole placement of temperature-sensing devices which indicate a sharp rise in temperature as the flame front arrives at the locus of the temperature-sensing device. One disadvantage in this method lies in the fact that the extremely high temperatures of the combustion front frequently destory the temperature-sensing apparatus. Another disadvantage is in the cost of drilling holes to the formation level.

The technique of self-potential profiling, long used to locate mineral deposits, has recently been found to be useful as a tool for locating buried geothermal reservoirs. This technique involves the detection of small self-potential voltages which result from natural earth currents. Two metal stakes are placed in conductive ground and connected to a sensitive voltmeter which detects the generation of electromotive force in the surrounding rocks due to increases in temperature. The effective range of this method is somewhat limited and dependent upon a large area of thermal variation to generate a measurable voltage. In an underground retort however, very poor electrical coupling exists between the rubble and the retort walls. It is expected that any self-potential voltages generated within the retort will be poorly transmitted to the walls. Therefore, the self-potential voltages detectable by the surface sensors will be primarily those generated from the immediately adjacent retort walls--a much smaller thermal source than the entire flame front. This significantly reduces the efficacy of this method in underground retorting. Like the infrared imaging technique this method adequately detects the presence of thermal anomalies, but provides little information concerning the depth or movement of such thermal fronts.

Scientists at the Lawrence Livermore Laboratories have recently explored the use of high frequency electromagnetic probing to investigate underground anomalies. One application of the radiofrequency (RF) probing is to observe the progress of a burn front in the experimental underground coal gasification process. This technique involves lowering radio transmitters and receivers into bore holes drilled around the area of concern. Underground irregularities which have an effect on the passage of the RF waves can then be detected and located. Varying geological features, however, also affect the passage of the RF waves. In addition, underground water pockets, or any other interface causing a change in the dielectric constant, would also affect the passage of the RF waves. This method is therefore susceptible to interference caused by the presence of normal subterranean features.

It can be seen that the methods taught by the prior art are, in general, directed towards either (1) detecting lateral movement of a flame front, or (2) the vertical movement of a flame front, but not both. In addition, even those methods which are capable of detecting the directional movement and location of the front do not provide a means for ascertaining whether the front is tilted out of a desired orientation. Such tilts are undesirable as they can cause incomplete or inefficient combustion in the retort. In general, the prior art does not provide a means of detecting both the lateral and vertical location of a flame front, the speed with which the flame front is propagating through the carbonaceous stratum and the degree to which the front deviates from a desired horizontal or vertical plane. Once these parameters of the underground flame front are detected, various means can be employed to selectively speed up or hinder portions of this flame front to more efficiently effectuate the retorting process.

The prior art similarly fails to address the problem of uneven flame propagation in a retort at its potential source—uneven size and density distribution of the particles in the rubble. There is a need for a method of determining packing variations of the rubble within a retort. Particularly dense or unusual portions of the retort would be candidates for additional explosive techniques. Other segments of the retort which require the injection of control gases to assure optimum combustion conditions can also be located once the packing variations are determined.

The primary object of this invention is to provide a method of determining the progress and pattern of a combustion front in a carbonaceous stratum which avoids the aforesaid difficulties. A more specific object of this invention is to provide a method of determining both the vertical and lateral movement of an underground flame front. Another object of this invention is to provide a means of ascertaining the spatial orientation of the plane of an underground flame front. A further object of this invention is to provde a means of determining the presence of variations in the size and density distribution of the rubblized shale in a retort.

SUMMARY OF THE INVENTION

The primary objects of this invention can be achieved through a method for detecting the flame front during the in situ combustion of a subterranean carbonacceous stratum which involves providing one or more radio transmitters below the surface of the ground, each of said transmitters being capable of sensing and transmitting information concerning the physical and chemical properties of its surroundings, and monitoring said transmissions as an indication of the extent and movement of said flame front.

The further objects of this invention can be achieved through a method for detecting non-uniform packing characteristics of rubblized material which involves providing one or more radio transmitters within the boundaries of a retort capable of sensing and transmitting information concerning the physical parameters of its surroundings, and monitoring said transmissions as an indication of the size and density distributions of the rubble in said retort.

For purposes herein, the term "transmitter" is understood to describe a unit capable of sensing information concerning its surroundings and transmitting this data to some receiving apparatus. Such transmitters may operate in continuous mode, short burst mode, or as transponders—sending data only when interrogated.

An array of radio transmitters, preferably battery powered, are located in the path of a flame front prior to arrival or ignition of the front. Each transmitter is intended to sense and transmit to a receiving station information concerning a variety of properties of the rock or rubble immediately surrounding the transmitter. These properties would include the temperature, pressure (both mechanical and gas), gas flow rate, gas composition ($CO_2$ or $O_2$ content, for example), and directional mechanical force. The number of properties each transmitter can sense and determine, and the attendant degree of accuracy, is obviously dependent upon the complexity of the transmitters—and this is theoretically limited only by the expense of the additional sophistication.

In the broadest application the individual units of this invention are sacrificial. That is, they are not recovered after the combustion is completed. These units are adequately insulated to withstand the flame front temperatures, and thereby function throughout the durtion of the combustion. The simplest units, however, are allowed to be destroyed as they are envaloped by the flame and thereby provide an additional reference point of the flame front's passage by their failure.

This method provides a highly flexible comprehensive system for determining a wide variety of parameters and conditions before, during or after the passage of a flame front. Additional sophistication is added in situations where the devices are chosen to be transponders. In this embodiment, the devices respond only to an interrogating signal transmitted from the surface. Battery life is conserved and particular information is obtained from a given transponder on command from the surface. Rationalizing the signals from these transponders by computer provides a clear picture of the conditions within and around the flame front. A slightly less sophisticated embodiment makes each device a simple transmitter continuously transmitting its identification code and whatever data is obtained from its surroundings. Again rationalizing the transmissions through a computer yields comprehensive data on the combustion parameters.

Specialization in the sensing devices is also allowed in this invention. Each transmitter in this embodiment is placed in an array and designed to detect only one or two parameters. For example, one set of transmitters detect temperature, another detect only pressure and another only flow rate. The information is then correlated and interpreted after reception at the surface. Such specialization has the effect of decreasing the complexity, and therefore the cost, of each individual unit.

To assure adequate transmission strength through the rubble and surrounding rock, the devices must operate in the very-high-frequency radio band region (on the order of a few megahertz). In general, higher frequencies are not transmitted well from the ground and lower frequencies tend to reduce the precision of the system.

This method can be employed to detect the flame front in cases where the combustion is expected to proceed vertically (as in a retort), laterally or even in cases where the direction of the combustion is erratic or unknown. When placed in the path of a lateral combustion front, the transmitters of this invention are capable of tracking the approach and recession of the flame front as well as the speed of propagation. In vertical or retort combustion, the probes are capable of monitoring the location, movement and spatial orientation of the flame front.

A significant factor in applying this method to a variety of combustion sites is that the transmitters should be placed in the ground and a reference reading of the parameters taken prior to the approach or ignition of the flame front. This reference reading is taken prior to any perturbations caused by the flame front. The flame front's progress and location is then determined by monitoring deviations from the reference reading caused by the advance of the front.

Limited only by the desirability of obtaining an initial "flame-free" or reference reading, the transmitters can be placed ahead of the advancing front in lateral combustion, or spaced in an array to track the progress of underground combustion with amorphous characteristics. It is clear however, that in order to be useful, each transmitter should lie within or very near the flame front at some stage of combustion. Transmitters placed so that they are never very close to the flame provide little information on the combustion front, except that the front never extended far enough to reach them. Consequently, it is necessary to at least roughly predict the flame path and make an effort to place the transmitters in this anticipated path. For this reason, the preferred direction of combustion is vertical. In vertical combustion, or more specifically, in vertical underground retorting of rubblized shale, the profile or boundary of the flame front remains relatively confined by the retort sidewalls during the entire retorting process. Thus, as the path of the flame front in a retort is relatively predictable, placement of the transmitters for maximum effectiveness and usage is facilitated.

BRIEF DESCRIPTION OF THE DRAWING

FIG. 1 is a schematic diagram of an array of transmitters located within a retort during combustion.

DETAILED DESCRIPTION OF THE INVENTION

FIG. 1 schematically depicts an irregularly shaped flame front moving down a vertical retort. The transmitters 10 are shown spaced in a regular array within the retort. Such regular configuration for the transmitters is achieved by placement of the transmitters in the retort after rubblization is complete. This is accomplished by hammering a hollow tube through the loose rubble—a process that is quicker and less expensive than boring through the pre-rubbled solid rock.

The spacing of the transmitters is not critical. Nevertheless the spacing in the array should be close enough so that no significant portion of the flame front is unattended. In a retort, transmitters are preferably placed no more than a few feet from any wall (including top and bottom surfaces) and preferably not further apart in any direction than one-fourth the retort dimension in that same direction.

As each transmitter is designed to sense or measure a variety of parameters concerning its immediate surroundings, the information received from any individual sensor/transmitter is limited to a relatively small portion of the retort volume. As a consequence, it is necessary to accurately determine the exact location of each transmitter so that the individual pieces of information can be assembled and, in aggregate, yield a comprehensive profile of conditions within the retort.

knowledge of the location of each transmitter is, of course, most easily obtained when the transmitters are inserted after rubblization as in FIG. 1. It is possible, however, to insert the transmitters into the retort area prior to rubblization. In this case, the transmitters are constructed shockproof and encased in strong protective shells to survive explosive rubblization. The final location of each transmitter after rubblization is then determined by triangulation or by directional ranging of the transmitted signals. Insertion prior to rubblization would involve the potentially expensive process of drilling to the desired depth. In addition, the rigid construction and shockproofing necessary to enable the transmitters to survive rubblization may also compromise the sensitivity and versatility of the sensors. For these reasons, placement in a predetermined array within the retort after rubblization is preferred.

It can be seen from FIG. 1 that, at any stage of combustion, some transmitters (11, 12) will be very near the flame front while others (14, 15) will be some distance away. Each unit in the array is assigned a unique identifying label. Prior to ignition of the shale the location and identification symbol of each transmitter is determined and plotted. Furthermore, each transmitter is designed to include an identifying label (a number or symbol) in all transmissions. The receiver is then capable of sorting out the signals and identifying the location of the source of every signal. The transmisions from transmitter 12, for example, are then monitored and correlated with the predetermined location of transmitter 12—thereby yielding information regarding conditions at a precise location within the retort.

In addition, due to their proximity to the combustion transmitters 11, 12 and 13 experience temperatures, pressures, gas concentrations, and flow rates denoting the presence of the flame front. In contrast, transmitters 14, 15, and 16 will experience considerably different parameters. Thus, monitoring the transmissions allows a determination of the proximity of each transmitter to the flame front. As the location of each transmitter is also known, an accurate determination of the location, movement and spatial orientation of the flame front is readily obtained.

Once it is possible to locate the source of every piece of information transmitted from within the retort, conventional computer systems can be emloyed to monitor, (receive, decode, identify, correlate and interpret) the received transmissions. In particular, sophisticated systems are currently available that are capable of rationalizing all received signals into a three dimensional pictorial representation of the flame front on a viewing screen. Such a pictorial display would facilitate the identification of portions of the retort which require the injection of control gases to help or hinder combustion—thus assuring optimum combustion and yield.

Whether inserted before rubblization or immediately after rubblization the transmitters have the additional advantage of enabling an investigation of the size and density distributions of the rubblized shale. Undesirable bypassing of portions of the rubblized shale (channeling) can be cuased by non-uniform rubble size or an irregular density distribution of the shale. Thus, if packing variations can be determined in the retort prior to ignition, then the effects of channeling can be mitigated somewhat by secondary rubblization in regions of poor shattering. Specifically, in this embodiment the devices are designed to measure mechanical pressure or the impingement of directional forces. This data is then monitored and interpreted to indicate overhead weight variations and thereby identify incomplete shattering regions. Such regions would be candidates for secondary rubblization.

As a consequence, a combination of transmitters and transponders inserted either before or after rubblization can allow determinations of the following retort aspects:

(1) the size and density distributions of the rubblized shale;

(2) regions within the retort that experienced incomplete rubblization;

(3) a mapping of the degree to which the retort conforms to the intended packing characteristics;

(4) temperature, pressure, gas flow rate, and gas composition at a variety of points within the retort after ignition of the shale (thereby indicating the efficiency of the combustion);

(5) the position, progress and spatial orientation of the flame front; and (6) the location of candidate areas for (a) secondary rubblization, or (b) injection of control gases to speed up or hinder specific portions of the flame front.

This type of remote instrumentation could supplement or augment other types of flame front detection methods as well. When used in tandem and correlated, such methods will provide a comprehensive profile of the retort throughout the entire retorting process.

While this invention has its preferable application to monitoring flame fronts in vertical retorts it is readily applicable to other forms of underground combustion. Flame fronts proceeding horizontally, obliquely to the surface, or in several directions simultaneously can be monitored and tracked with an appropriate choice of transmitters and transponders (whether specialized or general purpose) providing accuracy and precision tailored to the circumstances.

It is understood that those skilled in the art will recognize a variety of modifications and configurations of the invention that do not depart from the scope of this invention. Accordingly, the foregoing description is to be construed as illustrative only. It is not to be construed as a limitation upon the invention as defined in the following claims.

I claim:

1. In the in situ retorting of a subterranean carbonaceous stratum, a method for detecting non-uniform packing characteristics of rubblized material comprising (a) providing one or more radio transmitters within a retort, each of said transmitters being capable of sensing and transmitting information concerning one or more properties of its surroundings, and (b) monitoring said transmissions as an indication of the density distribution of the rubble in said retort.

2. The method of claim 1 wherein one or more of said transmitters is placed in said retort area before rubblization.

3. The method of claim 1 wherein one or more of said transmitters is capable of sensing mechanical pressure and the impingement of directional forces.

4. The method of claim 3 wherein said transmissions are interpreted to indicate overhead weight variations and regions of incomplete shattering.

5. The method of claim 4 wherein regions requiring secondary rubblization techniques are identified on the basis of the interpretation of said transmissions.

* * * * *